US007336238B2

(12) United States Patent
Rawnick et al.

(10) Patent No.: US 7,336,238 B2
(45) Date of Patent: Feb. 26, 2008

(54) SHAPED GROUND PLANE FOR DYNAMICALLY RECONFIGURABLE APERTURE COUPLED ANTENNA

(75) Inventors: James J. Rawnick, Palm Bay, FL (US); Timothy E. Durham, Palm Bay, FL (US); Stephen B. Brown, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 11/489,759

(22) Filed: Jul. 20, 2006

(65) Prior Publication Data

US 2006/0256027 A1 Nov. 16, 2006

Related U.S. Application Data

(62) Division of application No. 10/648,887, filed on Aug. 27, 2003, now Pat. No. 7,084,828.

(51) Int. Cl.
*H01Q 1/48* (2006.01)

(52) U.S. Cl. ..... 343/846; 343/700 MS

(58) Field of Classification Search ..... 343/846, 343/700 MS, 702, 789, 793
See application file for complete search history.

(56) References Cited

U.S. PATENT DOCUMENTS 5,545,511 A * 8/1996 Hulderman et al. ..... 430/315
5,792,236 A 8/1998 Taylor et al.
5,957,969 A 9/1999 Warner et al.
6,396,441 B2 * 5/2002 Perrott et al. ..... 343/700 MS
6,512,496 B2 1/2003 Alexeff et al.
6,633,161 B1 10/2003 Vaughan, Jr.
6,710,746 B1 3/2004 Anderson et al.
6,781,562 B1 8/2004 Lungwitz
6,833,772 B1 12/2004 Brown et al.
6,842,146 B2 1/2005 Alexeff et al.
6,859,189 B1 2/2005 Ramirez et al.
6,876,330 B2 4/2005 Alexeff et al.
6,906,680 B2 6/2005 Rawnick et al.
6,914,575 B2 7/2005 Rawnick et al.
6,952,145 B2 10/2005 Brown et al.
6,952,146 B2 10/2005 Brown et al.
6,960,965 B2 11/2005 Rawnick et al.
6,965,286 B2 11/2005 Rawnick et al.
6,967,628 B2 11/2005 Rawnick et al.

(Continued)

OTHER PUBLICATIONS

U.S. Appl. No. 10/330,756, filed Dec. 27, 2002, Rawnick et al.

*Primary Examiner*—Huedung Mancuso
(74) *Attorney, Agent, or Firm*—Darby & Darby; Robert J. Sacco

(57) ABSTRACT

Method for controlling an input impedance of an antenna (100). The method can include the steps of coupling RF energy from an input RF transmission line (106) to an antenna radiating element (102) through an aperture (112) defined in a ground plane (110). For example, the aperture (112) can be a slot and the radiating element (102) can be a patch type element. The input impedance can thereafter be controlled by selectively varying a volume or a position of a conductive fluid (128) disposed in a predetermined region between the RF transmission line and the antenna radiating element. The volume of conductive fluid (128) can be automatically varied in response to at least one control signal (132).

10 Claims, 6 Drawing Sheets

U.S. PATENT DOCUMENTS 6,972,728 B2 * 12/2005 Brown et al. ..... 343/786
6,975,188 B2 12/2005 Rawnick et al.
6,992,550 B2 1/2006 Rawnick et al.
7,084,828 B2 * 8/2006 Rawnick et al. ..... 343/846
2005/0048934 A1 * 3/2005 Rawnick et al. ..... 455/107
2006/0256027 A1 * 11/2006 Rawnick et al. ..... 343/861

* cited by examiner

SHAPED GROUND PLANE FOR DYNAMICALLY RECONFIGURABLE APERTURE COUPLED ANTENNA

CROSS REFERENCE TO RELATED APPLICATIONS

This application is a divisional of U.S. patent application Ser. No. 10/648,887, filed Aug. 27, 2003, now U.S. Pat. No. 7,084,828 which claims benefit of United States. The aforementioned related patent application is herein incorporated by reference.

BACKGROUND OF THE INVENTION

1. Statement of the Technical Field

The invention concerns antennas and more particularly aperture coupled antennas that can be dynamically modified to operate over a relatively large bandwidth by controlling a shape of a ground plane.

2. Description of the Related Art

Patch antennas are well known in the art and are used in a wide variety of applications. They can be manufactured in a nearly unlimited number of shapes and sizes, and can be made to conform to most surface profiles. Patch antennas also possess an omni-directional radiation pattern that is desirable for many uses.

One negative aspect of patch antennas is that they usually have a relatively narrow impedance bandwidth. For a typical classically fed patch antenna, bandwidth is usually about 2% to 3%. Patch antennas that are fed with an aperture or slot can have slightly higher bandwidths, in the range from about 4% to 6%, but this is still too narrow for many applications. The impedance of a patch antenna is also noteworthy as it can depart significantly from 50 ohms. Consequently, most patch antennas need proper matching in order to ensure efficient power transfer, particularly when fed with coaxial cables that can be lossy at high levels of VSWR.

Impedance matching for a patch antenna can be accomplished using several different approaches. For example, a quarter wave high impedance transmission line transformer can be used for this purpose. Alternatively since the impedance is at a minimum at the center of the patch and increases along the axis, a 50 ohm microstrip line can be extended into the interior of the patch to achieve a suitable match. In yet another alternative, a center conductor of a coaxial line can be routed through a dielectric substrate on which the conductive patch is disposed to contact the underside of the patch at a selected impedance point.

Still, the operation of most conventional matching circuitry will be frequency dependent. Accordingly, the input impedance of the antenna system will tend to vary considerably over a relatively large bandwidth. Consequently, the usable bandwidth of the conventional patch antenna will remain relatively limited.

SUMMARY OF THE INVENTION

The invention concerns a method for controlling an input impedance of an antenna by varying a shape of a ground plane. The method includes the steps of coupling RF energy from an input RF transmission line to an antenna radiating element through an aperture defined in the ground plane. The input impedance is controlled by selectively varying at least one dimension of the aperture in response to a control signal. The step of varying the dimension of the aperture can further comprise varying the volume and/or the position of a conductive fluid. According to one aspect of the invention, the radiating element can be selected to be a conductive metal patch. Further, the conductive fluid can be constrained in a dielectric cavity structure. The method can also include the step of forming the aperture as a slot. In that case, the method can also include varying a length of the slot transverse to a length of the RF transmission line. This added control of the impedance characteristics of the feed arrangement can be used to offset the impedance variation of the radiating element across frequency resulting in an overall flat impedance when the two are combined resulting in increased bandwidth.

The dimension of the aperture can be varied so as to maintain an input impedance in a pre-defined range over a selected range of frequencies. For example the input impedance can be controlled so that the VSWR observed at the input does not exceed about 2:1. Notably, the position and the volume of the conductive fluid can be varied in response to at least one feedback signal provided by a sensor.

According to another aspect, the invention can include an aperture coupled antenna. The antenna can be comprised of an RF transmission line defining an antenna input, an antenna radiating element; and an aperture defined in a ground plane. RF energy from the RF transmission line is coupled to the antenna radiating element through the aperture. The aperture as recited herein can be any of a variety of well known shapes which are commonly used for coupling RF, including a rectangular slot. The radiating element can be a conductive metal patch as is also well known in the art.

Further, a conductive fluid can be provided together with a fluid control system. The conductive fluid can electrically coupled with the ground plane so as to be at a common potential. The conductive fluid can be at least partially constrained in a dielectric cavity structure which can be formed, for example, from a low temperature cofired ceramic substrate. The fluid control system can selectively vary one or both of a volume and a position of the conductive fluid. Consequently, the conductive fluid can be used to modify at least one dimension of the aperture. In this way, the fluid control system can also be used to help control an input impedance of the antenna. For example, the control system can vary the volume and/or the position of the conductive fluid to maintain the input impedance in a pre-defined range over a selected range of frequencies.

According to one aspect of the invention the fluid control system can also include a controller for automatically varying the volume and/or the position of the conductive fluid in response to a control signal. The fluid control system can also include one or more the following: a valve, a pump, and a fluid reservoir. The control system can also include at least one sensor, and the controller can vary the position and the volume in response to a feedback signal provided by the sensor. The conductive fluid can be formed of a variety of materials, including fluids formed from gallium and indium alloyed with tin, copper, zinc or bismuth. Other conductive fluids include a variety of solvent-electrolyte mixtures that are well known in the art.

DETAILED DESCRIPTION OF THE PREFERRED EMBODIMENTS

Figure 1:
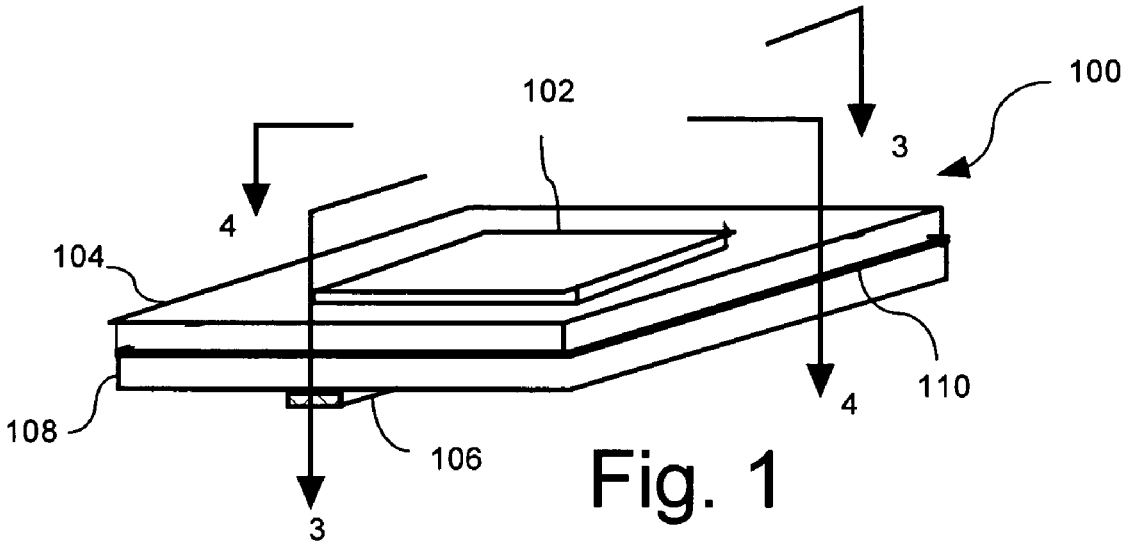
FIG. 1 is a perspective view of a patch antenna that is useful for understanding the present invention.

FIG. 1 is a perspective view of an aperture-fed patch antenna 100 that is useful for understanding the invention. The antenna is comprised of a radiating element 102 disposed on a dielectric antenna substrate 104. The radiating element 102 in FIG. 1 is shown as having a rectangular geometry as is common for patch type antennas, but it should be understood that the invention is not so limited. Instead, the radiating element 102 can have any of a wide variety of geometric designs as would be known to those skilled in the art.

A feed line 106 can be disposed on a surface of the antenna 100 opposed from the radiating element 102. According to a preferred embodiment, the feed line 106 can be a microstrip transmission line as shown. However, the invention is not limited in this regard and other arrangements are also possible. For example, feed line 106 could also be arranged in a buried microstrip or stripline configuration.

Figure 2:
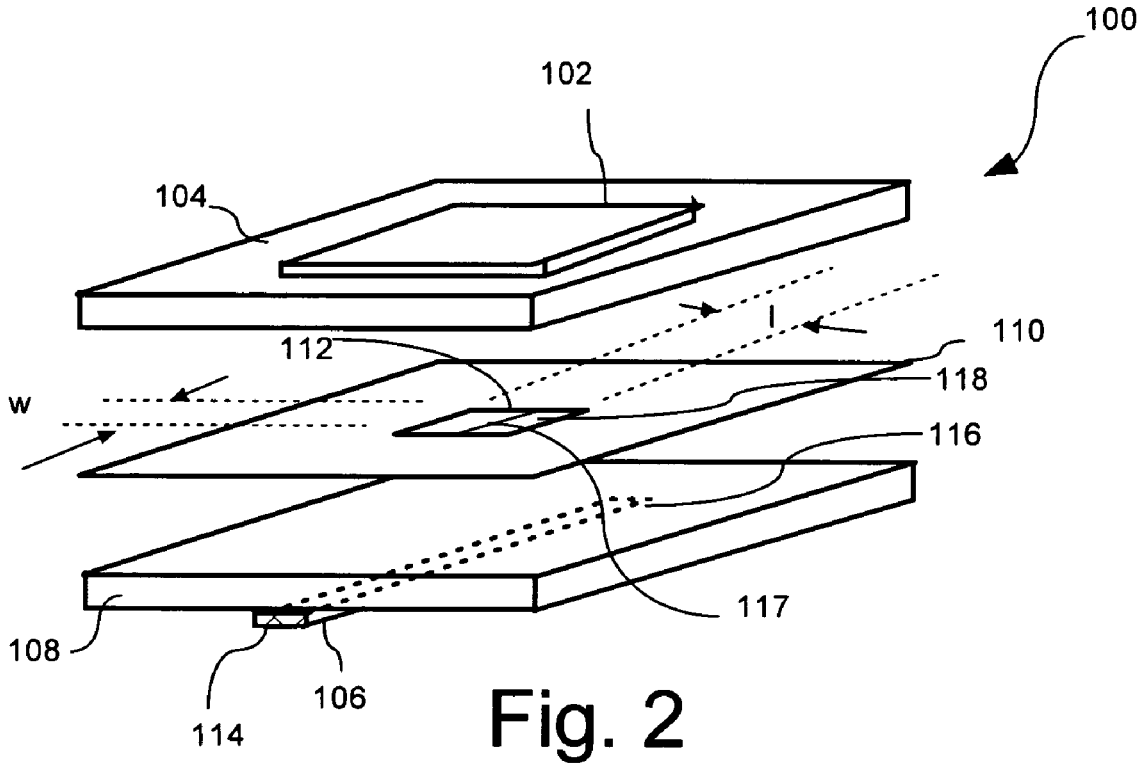
FIG. 2 is an exploded view of the patch antenna of FIG. 1.

As illustrated in FIGS. 1 and 2, the feed line 106 can be disposed on a dielectric feed substrate 108. The antenna substrate 104 can be separated from the feed substrate 108 by a conductive metal ground plane 110. The antenna substrate and the feed substrate can be formed from any of a number of commercially available forms of dielectric materials. For example, low and high temperature cofired ceramics (LTCC, HTCC) can be used for this purpose. An example of an LTCC would include low temperature 951 cofire Green TapeTM from Dupont®. This material is Au and Ag compatible and has acceptable mechanical properties. It is available in thicknesses ranging from 114 μm to 254 μm and is designed for use as an insulating layer in hybrid circuits, multichip modules, single chip packages, and ceramic printed wire boards, including RF circuit boards.

Alternatively, the dielectric substrates can be formed from other materials commonly used as RF substrates, including Teflon® PTFE (PolyTetraFluoroEthylene) composites of glass fiber, woven glass and ceramics. Such products are commercially available from a variety of manufacturers. For example, Rogers Corporation of Chandler, Ariz. offers such products under the trade name RT/duroid including product numbers 5880, 6002, and 6010LM. Unlike LTCC materials, these types of substrates do not generally require a firing step before they can be used.

An aperture 112 is preferably provided in the ground plane 110 for coupling RF energy from the feed line 106 to the radiating element 102. The aperture 112 is preferably a slot and can be approximately centered beneath the radiating element 102 in accordance with conventional aperture-fed patch antenna designs. However, other shapes and positions for the aperture 112 can also be acceptable. Further, the feed line 106 preferably traverses the area defined by the aperture 112 on a side of the feed substrate 108 opposed from the ground plane 110 and can include a stub that terminates somewhat beyond the point of intersection as shown.

With the arrangement of the antenna 100 as described herein, RF energy communicated to the feed line 106 at feed port 114 can be effectively coupled to the radiating element 102. In conventional aperture fed antenna systems, it is well known that there are several parameters that can be varied in order to control the input impedance of the antenna 100 as would be observed, for example, at feed port 114. These parameters include the length l and width w of the aperture 112, the width of feed line 106, the position of the aperture 112 relative to the radiating element 102 and the length of the feed line stub 116 extending past the aperture. Most commonly, the aperture length l (transverse to the feed line 106) and the length of stub 116 are selected to control the input impedance observed at an antenna feed port 114. The length of the aperture 112 determines the coupling level between the feed line 106 and the radiating element 102 and therefore can be used to vary the input impedance observed at antenna feed port 114. Changing the length of the stub can compensate for the inductance of the aperture so as to create a real impedance for the radiating element.

One problem with impedance matching using the foregoing approaches is that they are static systems which generally cannot be varied once the design is selected. The present invention provides an approach by which dynamic control over the input impedance can be achieved using fluids to vary the coupling between the feed line 106 and the radiating element 102.

According to one embodiment of the invention, coupling between the feed line 106 and the radiating element 102 can be controlled by selectively varying the size of the aperture 112. More particularly, by selectively controlling one or both of a volume and a position of a conductive fluid communicated to a cavity structure situated along at least one edge of the aperture 112, the size of the aperture can appear to be varied so as to control coupling.

Figure 3:
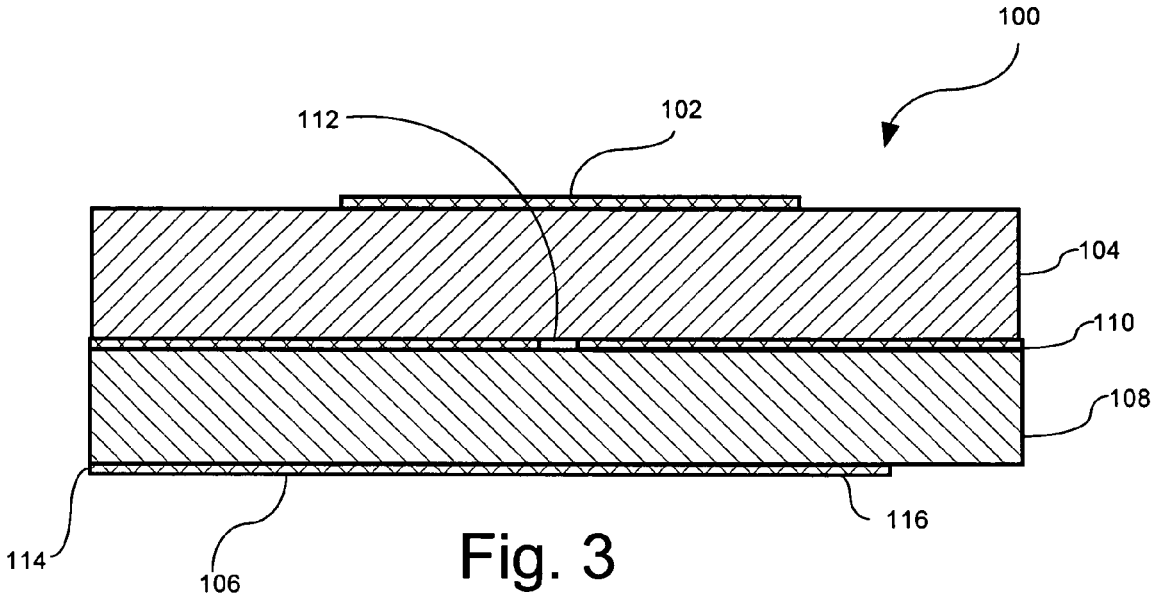
FIG. 3 is a cross-sectional view of the patch antenna of FIG. 1 taken along line 3-3.
Figure 4:
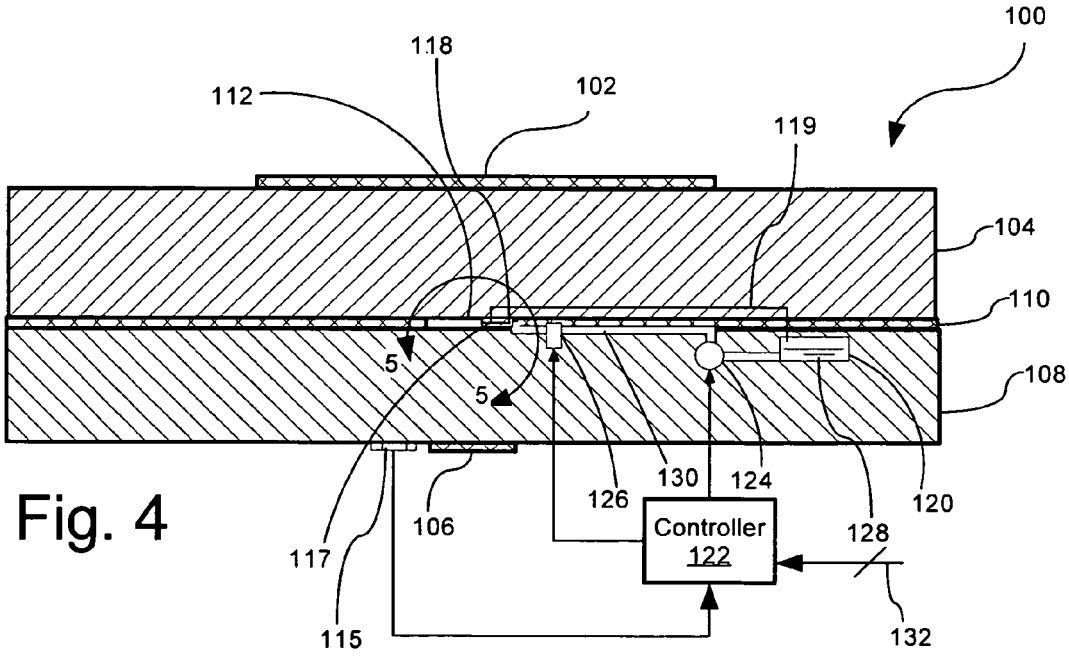
FIG. 4 is a cross-sectional view of the patch antenna of FIG. 1 taken along line 4-4.

Referring now to FIGS. 3 and 4, the antenna 100 is shown in cross-section along lines 3-3 and 4-4 respectively in FIG. 1. A fluid control system can be provided to selectively vary the volume of a conductive fluid 128 contained in a fluid cavity 118. The fluid control system can include any combination of fluid reservoirs, conduits, pumps, sensors, valves and controllers as may be appropriate for selectively varying the position and or volume of the conductive fluid communicated to the fluid cavity 118.

For example, in FIG. 4 it is shown that the antenna 100 can include a reservoir 120 for containing a volume of conductive fluid, a cavity structure 117 defining a cavity 118 disposed generally adjacent to at least one edge of the aperture 112, and fluid conduit 130 for communicating the conductive fluid between the reservoir 120 and the cavity 118. The cavity 118 can be in fluid communication with the reservoir 120 so that conductive fluid 128 can be added and removed from the cavity 118 as necessary. A pump 124 and a valve 126 can also be provided for moving and securing the position of the conductive fluid. The pump 124 and valve 126 can be responsive to signals received from a controller 122, which in turn, is responsive to an antenna control signal 132. Alternatively, the control signals for the pumps and valves can be generated manually.

Figure 5:
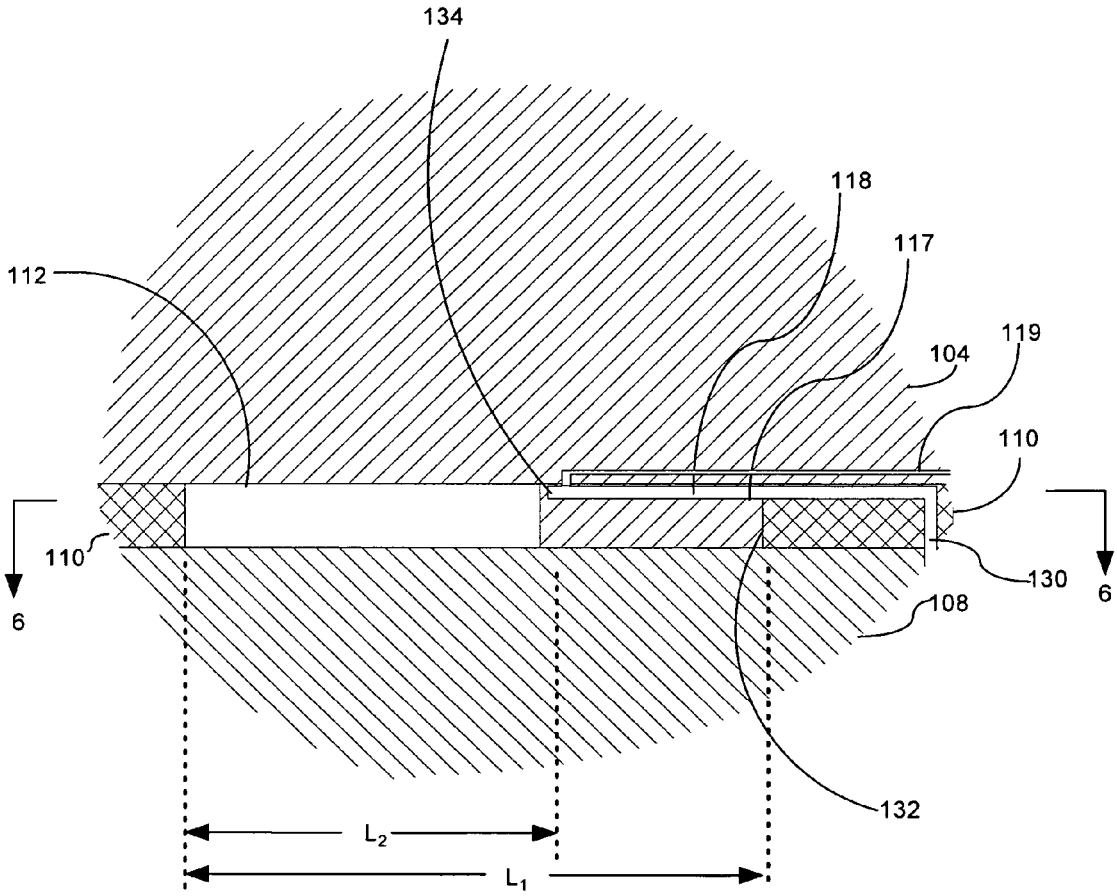
FIG. 5 is a cross-sectional view of a portion of the patch antenna in FIG. 4 taken along line 5-5
Figure 6:
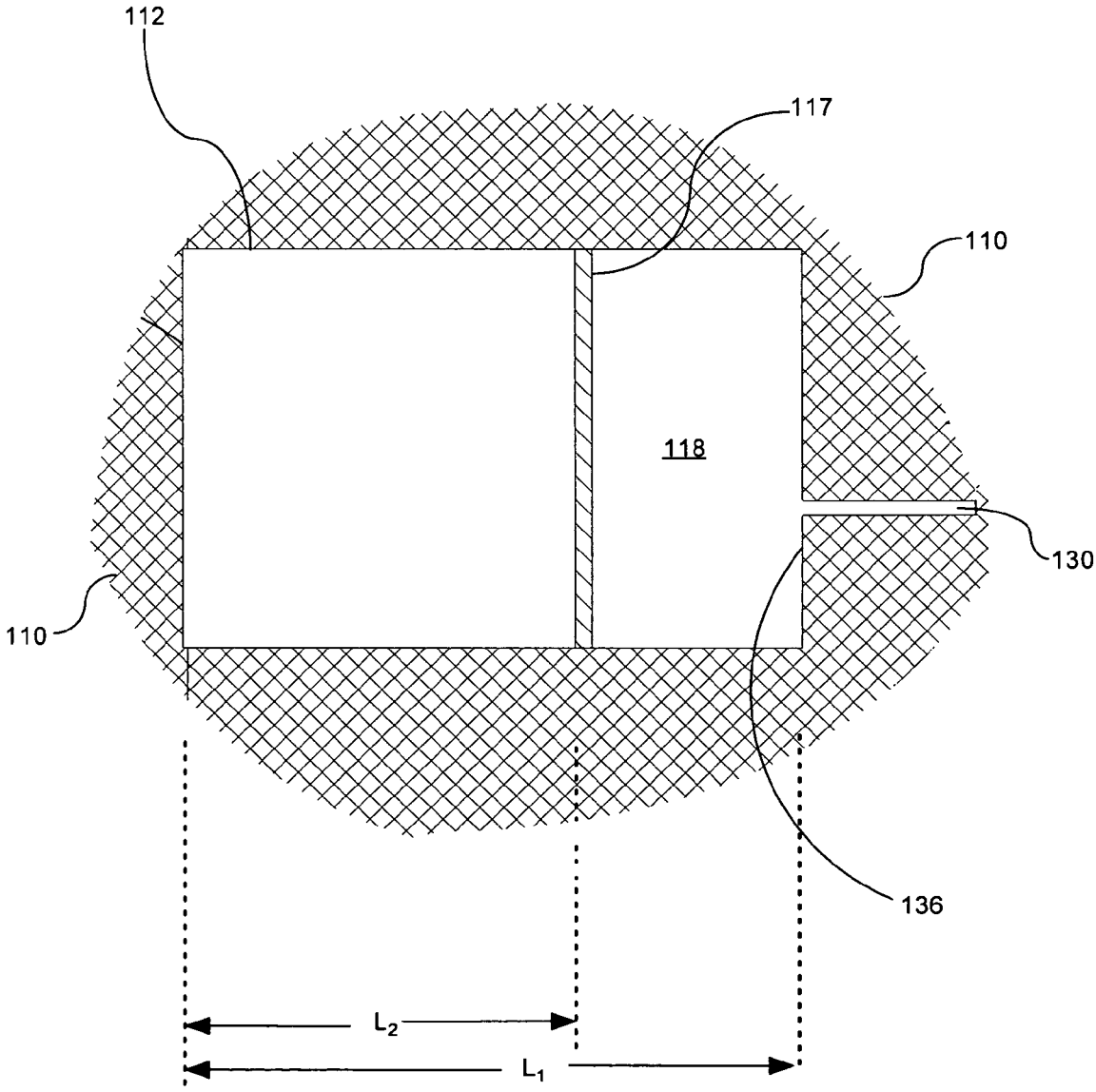
FIG. 6 is a cross-sectional view of the patch antenna taken along line 6-6 in FIG. 5.

FIG. 5 is an enlarged view of a portion of FIG. 4 in the area identified by line 5-5, and is useful for understanding how the conductive fluid 128 can be used to vary the dimensions of the aperture 112. FIG. 6 is a cross-sectional view along line 6-6 in FIG. 5. As shown in FIGS. 5 and 6, the cavity structure 117 can extend along at least one edge of the aperture 112 as shown. The cavity structure 117 is preferably formed of a dielectric material. According to one embodiment, the dielectric material can have a relative permittivity and permeability consistent with any dielectric contained within aperture 112. For example, if the aperture 112 is filled with air, the cavity structure 117 can be selected to have a relative permittivity and a relative permeability equal to approximately 1. However, the invention is not limited in this regard and different design criteria can suggest different values of permeability and permittivity for the dielectric material.

When conductive fluid is added to the cavity 118, the edge 136 of the conductive metal ground plane 110 can appear to be extended so as to decrease the length of the aperture 112 from $L_1$, to $L_2$. Conductive fluid 128 can be in electrical contact with a portion of ground plane 110. Accordingly, the conductive fluid added to the cavity 118 can appear to form a conductive sheet at a ground potential generally consistent with ground plane 110. In effect, the edge of the aperture 112 is moved from edge 136 to cavity end wall 134. If necessary, a vent channel 119 can be provided to vent any existing fluid or gas as conductive fluid 128 moves into and out of the cavity 118.

Figure 7:
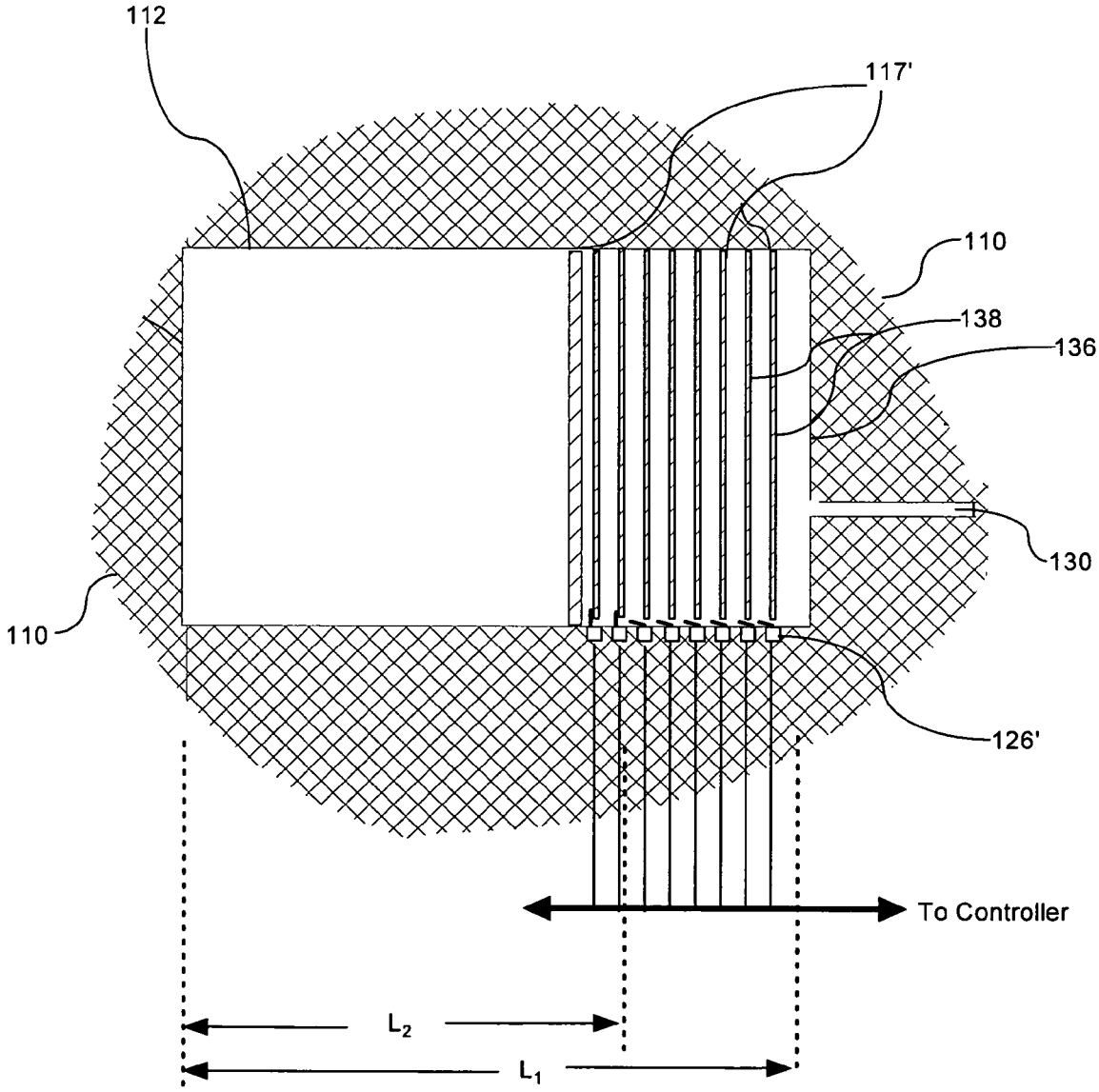
FIG. 7 is a cross-sectional view showing an alternative embodiment of the patch antenna in FIG. 6

FIG. 7 is similar to FIG. 6 except that it shows an alternative embodiment of a dielectric cavity structure 117'. Common structure in FIGS. 6 and 7 is designated with like reference numerals. FIG. 7 illustrates that a greater degree of control with regard to the length L of the slot 112 can be achieved by forming cavity structure 117' so as to further sub-divide cavity 118 using a plurality of dielectric walls 138. Further, a plurality of valves 126' can be used to control the flow of conductive fluid 128 past each of the dielectric walls 119. Selected ones of valves 126' can be opened or closed responsive to a control signal to vary the position of the conductive fluid relative to edge 136. If operating conditions change so that the length $L_2$ of the slot 112 is to be decreased further, additional valves 126' can be opened to increase the area of cavity 118 containing conductive fluid. If the length $L_2$ of the slot is to be decreased, the valves 126' can all be opened so that the conductive fluid can be purged from the cavity 118. Pump 124 can be used to actively purge cavity 118 of the conductive fluid. Alternatively, depending on the orientation of the antenna, the conductive fluid can be allowed to simply drain back into reservoir 120 by force of gravity. Thereafter, the position of valves 126' can be re-set and the conductive fluid 128 can once again be added to the cavity 118. Alternatively, additional pumps and or valves can be used to move the conductive fluid in and out of the chamber 118. Those skilled in the art will appreciate that the invention is not limited to the specific arrangement of pumps and valves shown in the figures, which are merely presented by way of example. In any case, suitable venting (not shown) can also be provided to allow gas contained in the cavity 118 to be displaced as the conductive fluid moves in and out.

Those skilled in the art will readily appreciate that arrangement of the fluid control system and cavity 118 is not limited to the precise embodiments shown. For example, instead of controlling the length of the aperture 112, the cavity 118 can be arranged extend outwardly from a different aperture edge so as to adjust a width rather than a length dimension. Once again, any combination of reservoirs, pumps, valves, conduits, sensors and cavities can be used to control the conductive fluid to so as to determine shape of the aperture 112. Further, those skilled in the art will appreciate that the pumps, valves, and other components of the fluid control system can be conventional type designs or can be formed as micro-electromechanical systems (MEMS) which are also known in the art. The controller 122 can be comprised of a microprocessor, a look-up-table, or any other type of electronic control circuit that is responsive to a control signal 132

The Conductive Fluid

According to one aspect of the invention, the conductive fluid used in the invention can be selected from the group consisting of a metal or metal alloy that is liquid at room temperature. The most common example of such a metal would be mercury. However, other electrically-conductive, liquid metal alloy alternatives to mercury are commercially available, including alloys based on gallium and indium alloyed with tin, copper, and zinc or bismuth. These alloys, which are electrically conductive and non-toxic, are described in greater detail in U.S. Pat. No. 5,792,236 to Taylor et al, the disclosure of which is incorporated herein by reference. Other conductive fluids include a variety of solvent-electrolyte mixtures that are well known in the art.

A system which relies on the presence or absence of a conductive fluid can also include some means to ensure that no conductive residue remains in/on the walls of the fluid cavities when the antenna is purged of conductive fluid. In this regard, the cavities containing conductive fluid can be flushed with a suitable solvent after the conductive fluid has been otherwise purged. This flushing can be performed manually or by an automated system. For example, in the case of conductive fluids which may consist of particles in solution or suspension, an active purging system (not shown) may be employed which uses a non-conductive fluid to flush the cavities of any remaining conductive particles. Still, the use of such an active purging system is merely a matter of convenience and the invention is not so limited.

Antenna Structure, Materials and Fabrication

According to one aspect of the invention, the antenna substrate 104 and the feed substrate 108 can be formed from a ceramic material. For example, the dielectric structure can be formed from a low temperature co-fired ceramic (LTCC). Processing and fabrication of RF circuits on LTCC is well known to those skilled in the art. LTCC is particularly well suited for the present application because of its compatibility and resistance to attack from a wide range of fluids. The material also has superior properties of wetability and absorption as compared to other types of solid dielectric material. These factors, plus LTCC's proven suitability for manufacturing miniaturized RF circuits, make it a preferred choice for use in the present invention.

Antenna Control Process

Figure 8:
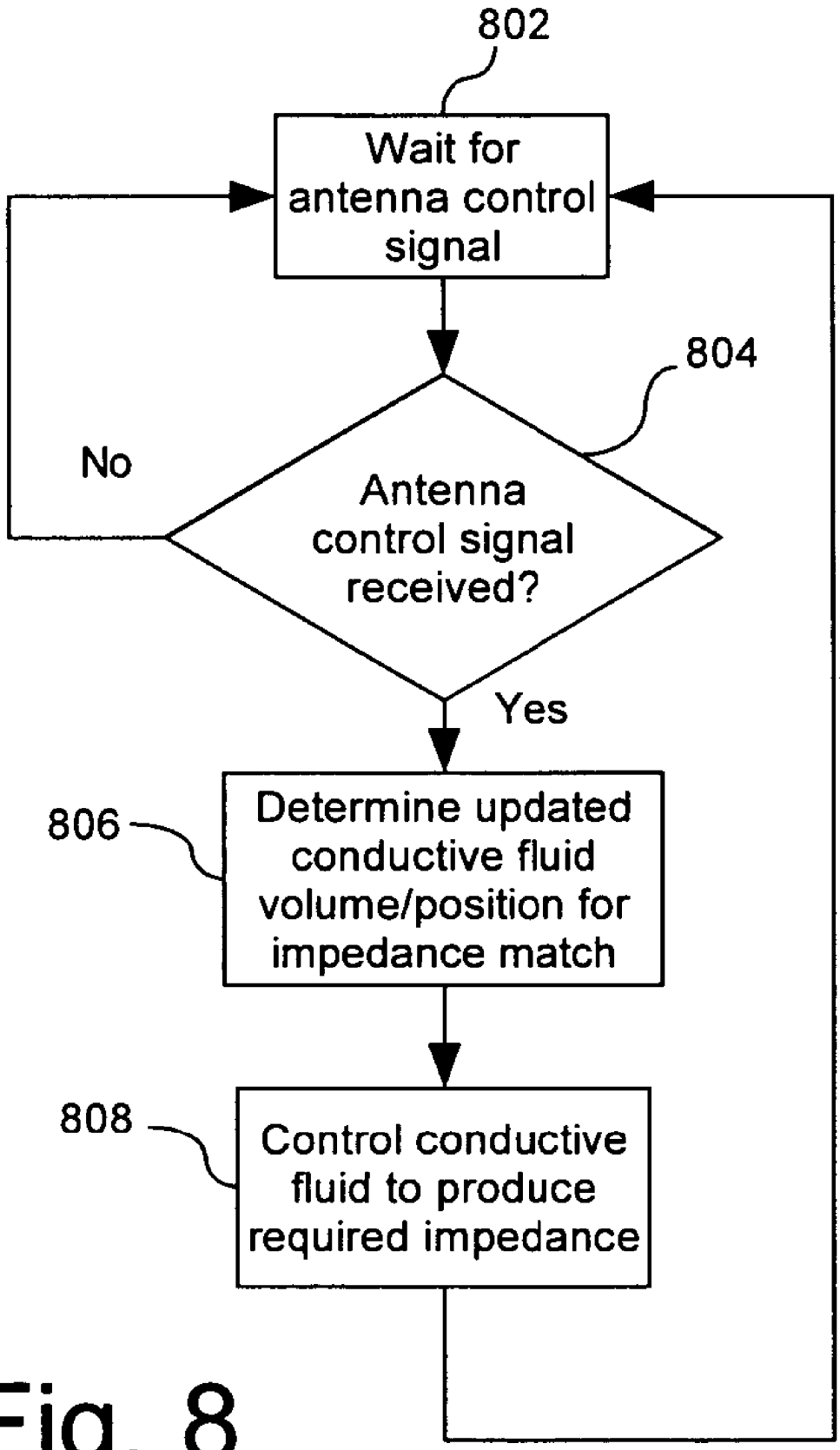
FIG. 8 is a flow chart illustrating a process for controlling an input impedance of the patch antenna.

Referring now to FIG. 8, a process shall be described for controlling the impedance matching system for the patch antenna as disclosed herein. In step 802 and 804, controller 122 can wait for an antenna control signal 132 indicating a required impedance matching condition. This impedance matching condition can indicate a relatively small change in frequency or a switch to a different band of frequencies. Once this information has been received, the controller 122 can determine in step 806 a required volume and/or positioning of conductive fluid 128 that is necessary in order to produce the required impedance match. In step 808, the controller 122 can selectively operate the pump 124 and valves 126, 126' to position the conductive fluid 128 as needed for achieving the required impedance match.

The volume and position of the conductive fluid can be calculated by controller 122 based on information contained in control signal 132. However, as an alternative to calculating the required configuration, the controller 122 could also make use of a look-up-table (LUT). The LUT can contain cross-reference information for determining control data for antenna 100 necessary to achieve various impedance matches. For example, a calibration process could be used to identify the specific output data from a sensor (not shown) communicated to controller 122 necessary to achieve a match at a particular frequency. These control signal values and sensor values could then be stored in the LUT. Thereafter, when control signal 121 is updated, the controller 122 can immediately operate the pump 124 and valve 126 or valves 126' to produce the sensor output data that is required to produce the impedance match indicated by the control signal.

As an alternative, or in addition to the foregoing methods, the controller 122 could make use of an iterative approach that measures a VSWR at an antenna input sensor 115 and then iteratively adjusts the volume and position of conductive fluid 128 contained in cavity 118 in order to achieve the lowest possible VSWR value. A feedback loop could be employed to control pump 124 and valves 126, 126' to minimize the measured VSWR.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

We claim:

1. A method for controlling an input impedance of an antenna, comprising the steps of:

positioning an input RF transmission line spaced apart from an antenna radiating element;

positioning a conductive ground plane between said input RF transmission line and said antenna radiating element;

coupling RF energy from said input RF transmission line to said antenna radiating element through an aperture defined in said conductive ground plane; and controlling said input impedance by selectively varying at least one dimension of said aperture in response to a control signal.

2. The method according to claim 1 further comprising the step of varying said at least one dimension to maintain an input impedance in a pre-defined range over a selected range of frequencies.

3. The method according to claim 1 further comprising the step of forming said aperture as a slot.

4. The method according to claim 3 wherein said step of varying said at least one dimension comprises varying a length of said slot transverse to a length of said RF transmission line.

5. The method according to claim 1 further comprising the step of selecting said radiating element to be a conductive metal patch.

6. A method for controlling an input impedance of an antenna comprising the steps of:

coupling RF energy from an input RF transmission line to an antenna radiating element through an aperture defined in a around plane;

controlling said input impedance by selectively varying at least one dimension of said aperture in response to a control signal; and wherein said step of varying said at least one dimension of said aperture further comprises varying at least one of a volume and a position of a conductive fluid.

7. The method according to claim 6 further comprising the step of varying at least one of said position and said volume in response to at least one feedback signal provided by a sensor.

8. The method according to claim 6 further comprising the step of constraining said conductive fluid in a dielectric cavity structure.

9. The method according to claim 6 wherein said conductive fluid is electrically coupled to said ground plane.

10. A method for controlling an input impedance of patch antenna, comprising the steps of:

configuring an aperture coupled patch antenna to have a first input impedance at a first operating frequency;

selectively varying at least one of volume and a position of a conductive fluid disposed in a predetermined region of said aperture coupled patch antenna between an input RF transmission line and an antenna radiating element to cause a second input impedance at a second operating frequency different from said first operating frequency to be approximately equal to said first input impedance.

* * * * *